US006991039B2

(12) United States Patent
Hopper et al.

(10) Patent No.: US 6,991,039 B2
(45) **Date of Patent: *Jan. 31, 2006**

(54) WELL OPERATIONS SYSTEM

(75) Inventors: Hans Paul Hopper, Aberdeen (GB); Thomas G. Cassity, Surrey (GB)

(73) Assignee: Cooper Cameron Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/844,871

(22) Filed: May 13, 2004

(65) Prior Publication Data

US 2004/0251036 A1 Dec. 16, 2004

Related U.S. Application Data

(60) Division of application No. 10/366,173, filed on Feb. 13, 2003, which is a division of application No. 09/657,018, filed on Sep. 7, 2000, now Pat. No. 6,547,008, which is a continuation of application No. 09/092,549, filed on Jun. 5, 1998, now abandoned, which is a division of application No. 08/679,560, filed on Jul. 12, 1996, now Pat. No. 6,039,119, which is a continuation of application No. 08/204,397, filed on Mar. 16, 1994, now Pat. No. 5,544,707.

(30) Foreign Application Priority Data

Jun. 1, 1992 (EP) ..... 92305014
May 28, 1993 (US) ..... PCT/US93/05246

(51) Int. Cl.
*E21B 33/035* (2006.01)

(52) U.S. Cl. ..... 166/348; 166/88.4; 166/89.1; 166/95.1; 166/368

(58) Field of Classification Search ..... 166/348, 166/368, 95.1, 88.4, 379, 89.1, 88.1
See application file for complete search history.

(56) References Cited

U.S. PATENT DOCUMENTS 3,602,303 A * 8/1971 Blenkarn et al. ..... 166/360
5,092,401 A * 3/1992 Heynen ..... 166/89.1

(Continued)

OTHER PUBLICATIONS

Memorandum and Order; Entered May 13, 2003; (44 p.).
Defendant Kvaerner Oilfield Products, Inc.'s Brief on the Construction of the Claims of United States Patent No. 6,039,119; Sep. 26, 2002; (pp.20) Appendix (pp. 2).
Plaintiff Cooper Cameron Corporation's Memorandum in Opposition to Kvaerner's Proposed Claim Construction; Oct. 17, 2002; (pp. 25).

(Continued)

*Primary Examiner*—Hoang Dang
(74) *Attorney, Agent, or Firm*—Conley Rose, P.C

(57) ABSTRACT

A wellhead has, instead of a conventional Christmas tree, a spool tree in which a tubing hanger is landed at a predetermined angular orientation. As the tubing string can be pulled without disturbing the tree, many advantages follow, including access to the production casing hanger for monitoring production casing annulus pressure, and the introduction of larger tools into the well hole without breaching the integrity of the well.

38 Claims, 16 Drawing Sheets

U.S. PATENT DOCUMENTS

| | | | | |
|---|---|---|---|---|
| 5,280,766 | A * | 1/1994 | Mohn | 166/368 |
| 5,372,199 | A * | 12/1994 | Cegielski et al. | 166/368 |
| 5,544,707 | A * | 8/1996 | Hopper et al. | 166/382 |
| 5,884,706 | A * | 3/1999 | Edwards | 166/335 |
| 6,039,119 | A * | 3/2000 | Hopper et al. | 166/368 |
| 6,547,008 | B1 * | 4/2003 | Hopper et al. | 166/348 |

OTHER PUBLICATIONS

Kvaerner's Reply to Plaintiff's Memorandum in Opposition to Kvaerner's Proposed Claim Construction; Oct. 31, 2002; (pp. 12).
Plaintiff Cooper Cameron Corporation's Sur-Reply Memorandum in Opposition to Kvaerner's Proposed Claim Construction; Nov. 14, 2002; (pp. 15).
Plaintiff Cooper Cameron Corporation's Supplemental Memorandum in Opposition to Kvaerner's Proposed Claim Construction; Nov. 23, 2003; (pp. 12).
Kvaerner's Response to Plaintiff's Supplemental Memorandum in Opposition to Kvaerner's Proposed Claim Construction; Feb. 4, 2003, (pp. 15)(Exhibits 20-25).
Plaintiff Cooper Cameron Corporation's Supplemental Memorandom in Support of Its Motion for Summary Judgment and on Claim Construction; Mar. 10, 2003; (pp. 11).
Plaintiff Cooper Cameron Corporation's Memorandum of Law Support of its Motion for Summary Judgment; filed Sep. 26, 2002; (59 p.).
Letter dated Nov. 10, 1997 from Stephen H. Cagle to Lester L. Hewitt; (3 p.).
Declaration of Peter J. Doyle, signed Nov. 17, 1999 (4 p.).
Letter dated Nov. 10, 1999 from Stephen H. Cagle to Lester L. Hewitt; (14 p.).
Letter dated Mar. 14, 2000 from Lester L. Hewitt to Stephen H. Cagle; (13 p.).
Defendent Kvaerner Oilfield Products, Inc.'s Opposition to Plaintiff's Motions for Summary Judgment; filed Oct. 17, 2002; (59 p.).
Expert Statement of Mark M. Newman; signed Apr. 21, 1998; (34 p.).
Supplemental Expert Statement and Declaration of Mark M. Newman; signed Oct. 1, 2002; (4 p.).
Letter dated Jan. 14, 1999 from John R. Keville to Lester L. Hewitt (2 p.); with attached Declaration of Sigbjorn Sangesland (13 p.); (undated).
Various pages of vol. 1 of Deposition of Sigbjorn Sangesland Dated Oct. 27, 1999 (10 p.); Various pages of vol. II of Deposition of Sigbjorn Sangesland Dated Oct. 28, 1999 (2 p.);, Various pages of vol. III of Deposition of Sigbjorn Sangesland Dated Oct. 29, 1999 (8 p.).
Deposition Exhibit 435; Fax dated Apr. 12, 1995 from Dave Garnham re barrier requirements ; CCLE 007463-007468; (6 p.).
Declaration of Bruce C. Volken, P.E. In Support of Defendant Kvaerner Oilfield Products, Inc.'s Opposition to Plaintiff's Motions for Summary Judgment; (14 p.).
Vol. IV of Desposition of Han Paul Hopper dated Feb. 25, 1998 (5 p.).
Vol. III of Deposition of Thomas Gus Cassity, dated July 7, 1998 (pp. 579, 599-601); Vol. 1 of Deposition of Thomas Gus Cassity, dated May 28, 1998 (pp. 90-91: Amendent Sheet (1 p.); Reporter's Certification (p. 246).
Expert Report of Benton F. Baugh; (undated) (pp. 2-12).
Letter dated Apr. 20, 1993 from B V G Manning to Kerr-McGee Oil (UK) Ltd.; re: Gryphon Project GDP-9201 (1 p.); with various answers to questions asked by HSE; (CCLE 000281-CCLE 000288).
Fax sheet from Bruce Manning to Bart Boudreaux; dated Jun. 21, 1993 re: *Operational Procedure*(1 p.).
Deposition of Benton F. Baugh, Ph. D., P.E., dated Aug. 25, 1998 (pp. 220-225 and 294) and Corrections to Aug. 25, 1998 Deposition (3 p. and p. 293; 295, 296).
Declaration of Frank Close dated Oct. 8, 2002 (1 p.); with Tab "A" attached including a Cameron drawing.
Declaration of David Lorimetr dated Oct. 7, 2002. with Tab "A", Drawing PD002616-2618; Tab "B", J. S. Horne letter dated Sep. 19, 1991 with drawing: Tab "C", amended drawing by Cooper (drawing PD0002616A); Tab D; Minutes of Meeting of Jun. 11, 1991 (2 p.).
Fax dated Aug. 20, 1991 to Norman Ritchie re: Texaco Petronella Horizontal Tree Assy. (pp. CCLE 22263-CCLE 22264).
Inter-Office Correspondance Dated Feb. 13, 1992 from Larry Hoes to Distribution; re: Technical Highlights Summary, Jan. 1992; (pp. CCH 34371-CCH 34379).
Deposition Exhibit 28; page from Hopper diary Dated Nov. 21, 1991; (1 p.).
Deposition of Stephen A. Hatton dated May 7, 1998; (pp. 24, 139, 140).
Norwegian Petroleum Directorate; *Regulation Concerning Drilling and Well Activities and Geological Data Collection in the Petroleum Activities*; 1992; (KON 04942-KON 0954).
Supplementary & Rebuttal Report of Benton F. Baugh; dated May 13, 1998; (pp. 20).
Deposition Exhibit No. 654 dated Oct. 29, 1999 of Sangesland; (1 p.).
Letter dated Nov. 18, 1999 from John R. Keville to Lester L. Hewitt (2 p.); with attached signed Declaration of Peter J. Doyle dated Nov. 17, 1999 (4 p.).
Letter dated Dec. 17, 1999 from Lester L. Hewitt to John R. Keville; (pp. 5).
Deposition of David A. Rose dated Jan. 11, 2001; (pp. 14; 62-71; 75-76; 81-84; 115-116; 129-130; 146).
Plaintiff Cooper Cameron Corporation's Reply Memorandum in Support of its Motions for Summary Judgment; filed Nov. 7, 2002; (pp. 1-35).
Kvaerner's Surreply to Plaintiff's Reply Memorandum in Support of its Motions for Summary Judgment; filed Nov. 21, 2002; (pp. 1-26).
vol. I, Deposition of Sigbjorn Sangesland dated Oct. 27, 1999; (pp. 1-61).
vol. II, Deposition of Sigbjorn Sangesland dated Oct. 28, 1999; (pp. 1-56).
vol. III, Deposition of Sigbjorn Sangesland dated Oct. 29, 1999; (pp. 1-56).
Kvaerner Opposition EP 0719905 with exhibits; Nov. 29, 2001 (pp. 232).
FMC Opposition EP 0719905 with exhibits; Dec. 5, 2001 (pp. 128).
Cameron Response to FMC Opposition; Jun. 18, 2002;(pp. 14).
Cameron Response to Kvaerner Opposition with Scott Depo Exhibit; Jun. 18, 2002; (pp. 29).
FMC Reply to Cameron Response; Jun. 17, 2003;(pp. 13).
EPO Preliminary Opinion; Feb. 16, 2005;(pp. 14).
Deposition of Martin Bowring; Jul. 21, 1998; (4 p.).

Document No. SIS/005/012; *Participation Agreement Relating to The Development of Subsea Submersible Pumping*; (KAS 10750-10793).
vol. 2; Deposition of Peter Scott, Sep. 19, 1998; (pp. 9).
Document No. SSP-020-004; Vetco Gray; *Conceptual Design Report Task Series 2000 Exhibit 295*; Jan. 1992; (pp. KAS09817-KAS09938).
Decision Rejection The Opposition (Article 102(2) EPC); Dated Aug. 5, 2005; (pp. 22).

Minutes of the Oral proceedings before the Opposition Division dated Aug. 5, 2005; (pp. 11.).

* cited by examiner

WELL OPERATIONS SYSTEM

This is a divisional application of co-pending application Ser. No. 10/366,173 filed Feb. 13, 2003 which is a divisional of application Ser. No. 09/657,018 filed Sep. 7, 2000 U.S. Pat. No. 6,547,008 which is a continuation of application Ser. No. 09/092,549 filed Jun. 5, 1998 now abandoned which is a divisional continuing application of Ser. No. 08/679,560 filed Jul. 12, 1996, now U.S. Pat. No. 6,039,119, which is a continuation of Ser. No. 08/204,397 filed Mar. 16, 1994, now U.S. Pat. No. 5,544,707, which claims the benefit of PCT application PCT/US93/05246 filed on May 28, 1993, which claims the priority of European Patent Office application 92305014 filed on Jun. 1, 1992, all of the above hereby incorporated herein by reference.

Conventionally, wells in oil and gas fields are built up by establishing a wellhead housing, and with a drilling blow out preventer stack (BOP) installed, drilling down to produce the well hole whilst successively installing concentric casing strings, which are cemented at the lower ends and sealed with mechanical seal assemblies at their upper ends. In order to convert the cased well for production, a tubing string is run in through the BOP and a hanger at its upper end landed in the wellhead. Thereafter the drilling BOP stack is removed and replaced by a Christmas tree having one or more production bores containing actuated valves and extending vertically to respective lateral production fluid outlet ports in the wall of the Christmas tree.

This arrangement has involved problems which have, previously, been accepted as inevitable. Thus any operations down hole have been limited to tooling which can pass through the production bore, which is usually no more than five inch diameter, unless the Christmas tree is first removed and replaced by a BOP stack. However this involves setting plugs or valves, which may be unreliable by not having been used for a long time, down hole. The well is in a vulnerable condition whilst the Christmas tree and BOP stack are being exchanged and neither one is in position, which is a lengthy operation. Also, if it is necessary to pull the completion, consisting essentially of the tubing string on its hanger, the Christmas tree must first be removed and replaced by a BOP stack. This usually involves plugging and/or killing the well.

A further difficulty which exists, particularly with subsea wells, is in providing the proper angular alignment between the various functions, such as fluid flow bores, and electrical and hydraulic lines, when the wellhead equipment, including the tubing hanger, Christmas tree, BOP stack and emergency disconnect devices are stacked up. Exact alignment is necessary if clean connections are to be made without damage as the devices are lowered into engagement with one another. This problem is exacerbated in the case of subsea wells as the various devices which are to be stacked up are run down onto guide posts or a guide funnel projecting upwardly from a guide base. The post receptacles which ride down on to the guide posts or the entry guide into the funnel do so with appreciable clearance. This clearance inevitably introduces some uncertainty in alignment and the aggregate misalignment when multiple devices are stacked, can be unacceptably large. Also the exact orientation will depend upon the precise positions of the posts or keys on a particular guide base and the guides on a particular running tool or BOP stack and these will vary significantly from one to another. Consequently it is preferable to ensure that the same running tools or BOP stack are used for the same wellhead, or a new tool or stack may have to be specially modified for a particular wellhead. Further misalignments can arise from the manner in which the guide base is bolted to the conductor casing of the wellhead.

In accordance with the present invention, a wellhead comprises a wellhead housing; a spool tree fixed and sealed to the housing, and having at least a lateral production fluid outlet port connected to an actuated valve; and a tubing hanger landed within the spool tree at a predetermined angular position at which a lateral production fluid outlet port in the tubing hanger is in alignment with that in the spool tree.

With this arrangement, the spool tree, takes the place of a conventional Christmas tree but differs therefrom in having a comparatively large vertical through bore without any internal valves and at least large enough to accommodate the tubing completion. The advantages which are derived from the use of such spool tree are remarkable, in respect to safety and operational benefits.

Thus, in workover situations the completion, consisting essentially of the tubing string, can be pulled through a BOP stack, without disturbing the spool tree and hence the pressure integrity of the well, "whereafter full production casing drift access is provided to the well through the large bore in the spool tree. The BOP can be any appropriate workover BOP or drilling BOP of opportunity and does" not have to be one specially set up for that well.

Preferably, there are complementary guide means" on the tubing hanger and spool tree to rotate the tubing hanger into the predetermined angular position relatively to the spool tree as the tubing hanger is lowered on to its landing. With this feature the spool tree can be landed at any angular orientation onto the wellhead housing and the guide means ensures that the tubing string will rotate directly to exactly the correct angular orientation relatively to the spool tree quite independently of any outside influence. The guide means to control rotation of the tubing hanger into the predetermined angular orientation relatively to the spool tree may be provided by complementary oblique edge surfaces one facing downwardly on an orientation sleeve depending from the tubing hanger the other facing upwardly on an orientation sleeve carried by the spool tree.

Whereas modern well technology provides continuous access to the tubing annulus around the tubing string, it has generally been accepted as being difficult, if not impossible, to provide continuous venting and/or monitoring of the pressure in the production casing annulus, that is the annulus around the innermost casing string. This has been because the production casing annulus must be securely sealed whist the Christmas tree is fitted in place of the drilling BOP, and the Christmas tree has only been fitted after the tubing string and hanger has been run in, necessarily inside the production casing hanger, so that the production casing hanger is no longer accessible for the opening of a passageway from the production casing annulus. However, the new arrangement, wherein the spool tree is fitted before the tubing string is run in provides adequate protected access through the BOP and spool tree to the production casing hanger for controlling a passage from the production casing annulus.

For this purpose, the wellhead may include a production casing hanger landed in the wellhead housing below the spool tree; an isolation sleeve which is sealed at its lower end to the production casing hanger and at its upper end to the spool tree to define an annular void between the isolation sleeve and the housing; and an adapter located in the annular space and providing part of a passage from the production casing annulus to a production casing annulus pressure monitoring port in the spool tree, the adapter having a valve for opening and closing the passage, and the valve being operable through the spool tree after withdrawal of the isolation sleeve up through the spool tree. The valve may be provided by a gland nut, which can be screwed up and down within a body of the adapter to bring parts of the passage formed in the gland nut and adapter body, respectively, into and out of alignment with one another. The orientation sleeve for the tubing hanger may be provided within the isolation sleeve.

Production casing annulus pressure monitoring can then be set up by method of completing a cased well in which a production casing hanger is fixed and sealed by a seal assembly to a wellhead housing, the method comprising, with BOP installed on the housing, removing the seal assembly and replacing it with an adapter which is manipulatable between configurations in which a passages from the production casing annulus up past the production casing hanger is open or closed; with the passage closed, removing the BOP and fitting to the housing above the production casing hanger a spool tree having an internal landing for a tubing hanger; installing a BOP on the spool tree; running a tool down through the BOP and spool tree to manipulate the valve and open the passage; inserting through the BOP and spool tree an isolation sleeve, which seals to both the production casing and spool tree and hence defines between the sleeve and casing an annular void through which the passage leads to a production caning annulus pressure monitoring port in the spool tree; and running a tubing string down through the BOP and spool tree until the tubing hanger lands in the spool tree with lateral outlet ports in the tubing hanger and spool tree for production fluid flow, in alignment with one another.

According to a further feature of the invention the spool tree has a downwardly depending location mandrel which is a close sliding fit within a bore of the wellhead housing. The close fit between the location mandrel of the spool tree and the wellhead housing provides a secure mounting which transmits inevitable bending stresses to the housing from the heavy equipment, such as a BOP, which projects upwardly from the top of the wellhead housing, without the need for excessively sturdy connections. The location mandrel may be formed as an integral part of the body of the spool tree, or may be a separate part which is securely fixed, oriented and sealed to the body.

Pressure integrity between the wellhead housing and spool tree may be provided by two seals positioned in series one forming an environmental seal (such as an AX gasket) between the spool tree and the wellhead housing, and the other forming a production seal between the location mandrel and either the wellhead housing or the production casing hanger.

During workover operations, the production casing annulus can be resealed by reversing the above steps, if necessary after setting plugs or packers down hole.

When production casing pressure monitoring is unnecessary, so that no isolation sleeve is required, the orientation sleeve carried by the spool tree for guiding and rotating the tubing hanger down into the correct angular orientation may be part of the spool tree location mandrel itself.

Double barrier isolation, that is to say two barriers in series, are generally necessary for containing pressure in a well. If a spool tree is used instead of a conventional Christmas tree, there are no valves within the vertical production and annulus fluid flow bores within the tree, and alternative provision must be made for sealing the bore or bores through the top of the spool tree which provide for wire line or drill pipe access.

In accordance with a further feature of the invention, at least one vertical production fluid bore in the tubing hanger is sealed above the respective lateral production fluid outlet port by means of a removable plug, and the bore through the spool tree being sealed above the tubing hanger by means of a second removable plug.

With this arrangement, the first plug, takes the function of a conventional swab valve, and may be a wireline set plug. The second plug could be a stopper set in the spool tree above the tubing hanger by, e.g., a drill pipe running tool. The stopper could contain at least one wireline retrievable plug which would allow well access when only wire line operations are called for. The second plug should seal and be locked internally into the spool tree as it performs a barrier to the well when a BOP or intervention module is deployed. A particular advantage of this double plug arrangement is that, as is necessary to satisfy authorities in some jurisdictions, the two independent barriers are provided in mechanically separate parts, namely the tubing hanger and its plug and the second plug in the spool tree.

A further advantage arises if a workover port extends laterally through the wall of the spool tree from between the two plugs; a tubing annulus fluid port extends laterally through the wall of the spool tree from the tubing annulus; and these two ports through the spool tree are interconnected via an external flow line containing at least one actuated valve. The bore from the tubing annulus can then terminate at the port in the spool tree and no wireline access to the tubing annulus bore is necessary through the spool tree as the tubing annulus bore can be connected via the interplug void to choke or kill lines, i.e. a BOP annulus, so that downhole circulation is still available. It is then only necessary to provide wireline access at workover situations to the production bore or bores. This considerably simplifies workover BOP and/or riser construction. When used in conjunction with the plug at the top of the spool tree, the desirable double barrier isolation is provided by the spool tree plug over the tubing hanger, or workover valve from the production flow.

When the well is completed as a multi production bore well, in which the tubing hanger has at least two vertical production through bores each with a lateral production fluid flow port aligned with the corresponding port in the spool tree, at least two respective connectors may be provided for selective connection of a single bore wire line running tool to one or other of the production bores, each connector having a key for entering a complementary formation at the top of the spool tree to locate the connector in a predetermined angular orientation relatively to the spool tree. The same type of alternative connectors may be used for providing wireline or other running tool access to a selected one of a plurality of functional connections, e.g. electrical or hydraulic couplings, at the upper end of the tubing hanger.

The development and completion of a subsea wellhead in accordance with the present invention are illustrated in the accompanying drawings, in which.

Figure 1:
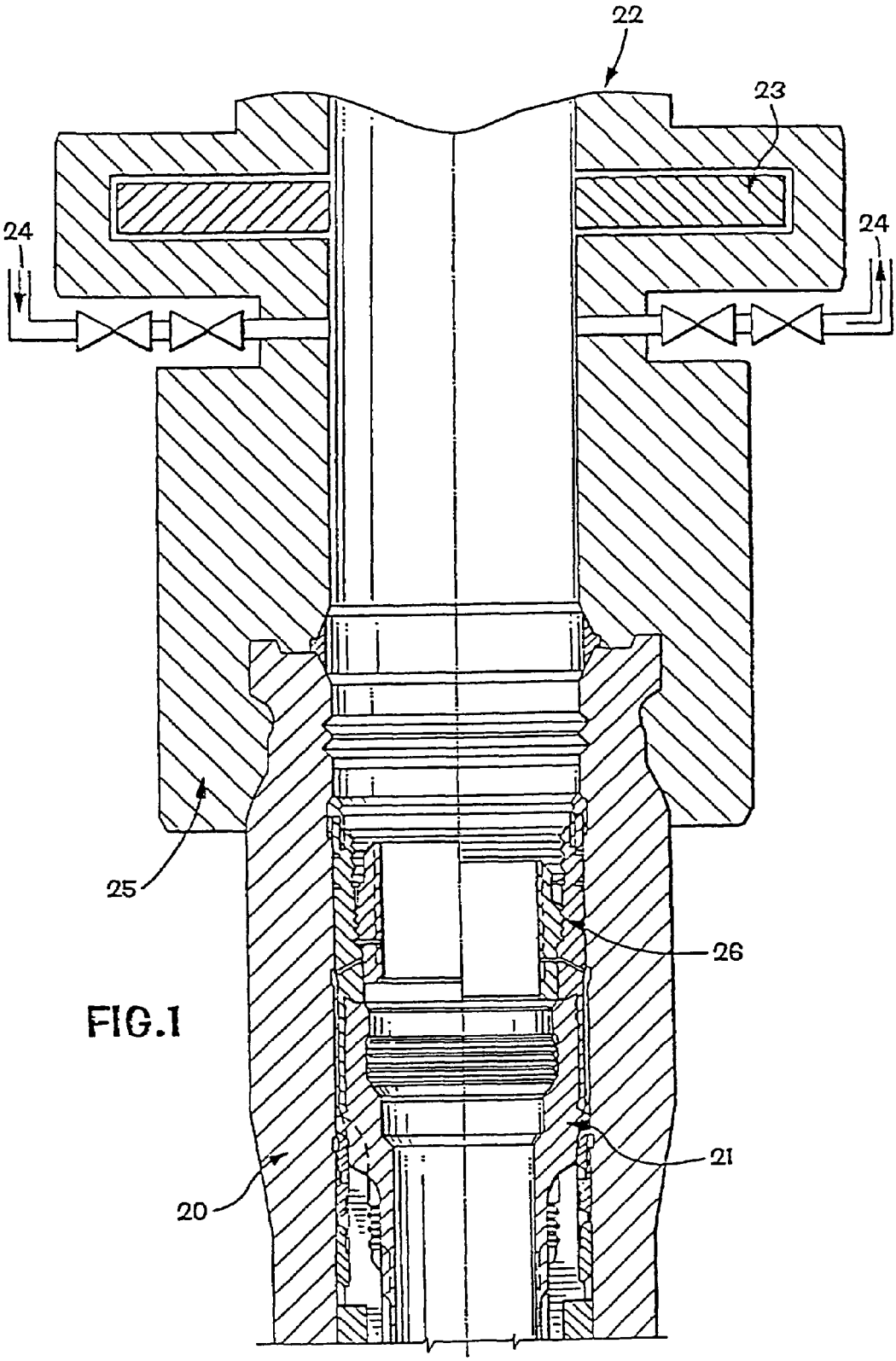
FIGS. 1 to 8 are vertical axial sections showing successive steps in development and completion of the wellhead, the Figure numbers bearing the letter A being enlargements of part of the corresponding Figures of same number without the A.

FIG. 1 shows the upper end of a cased well having a wellhead housing 20, in which casing hangers, including an uppermost production casing hanger 21 for, for example, 9⅝" or 10¾", production casing is mounted in conventional manner. FIG. 1 shows a conventional drilling BOP 22 having rams 23 and kill and choke lines 24 connected to the upper end of the housing 20 by a drilling connector 25.

Figure 1A:
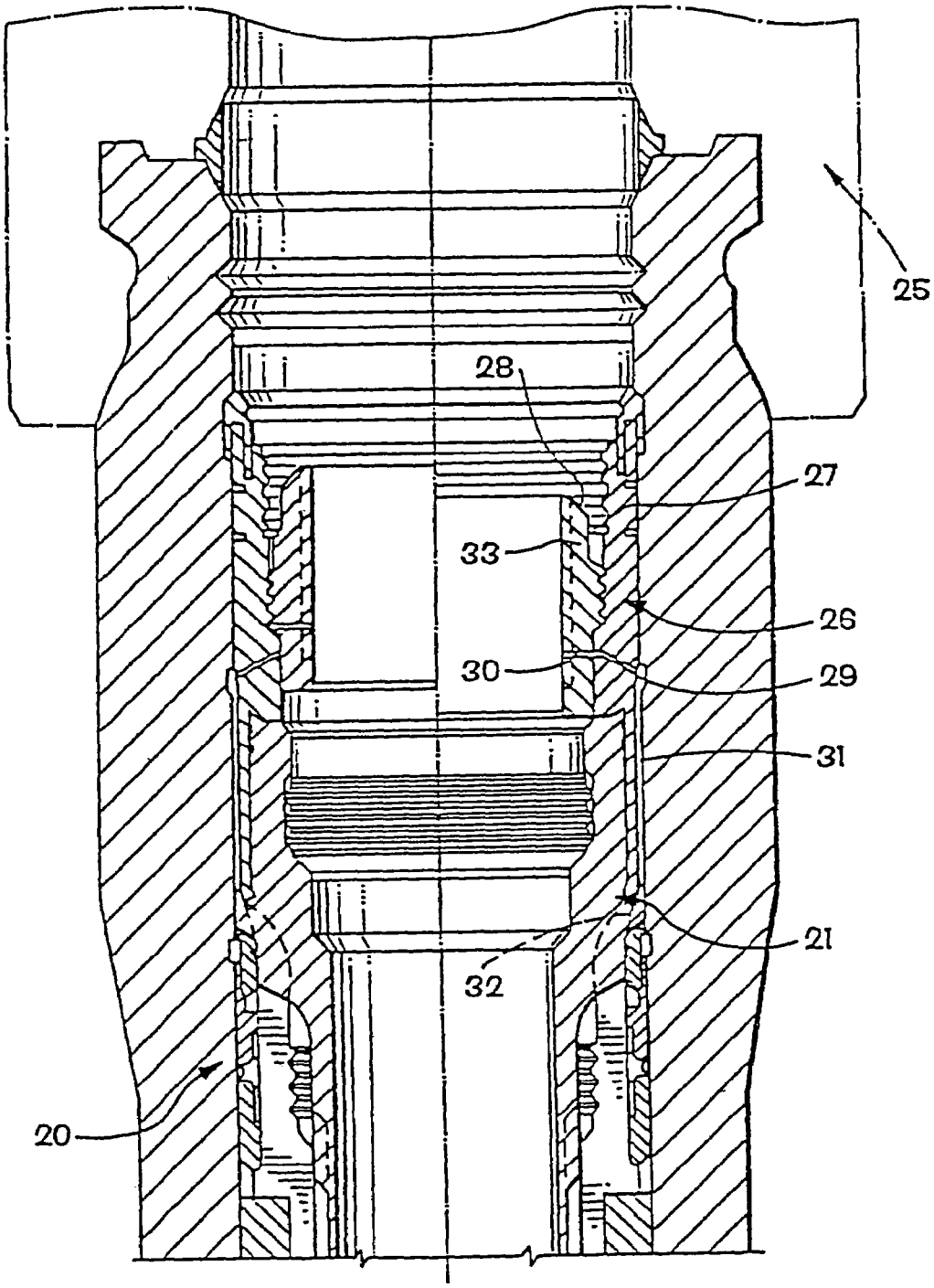

As seen in more detail in FIG. 1A, the usual mechanical seal assemblies between the production casing hanger 21 and the surrounding wellhead housing 20 have been removed and replaced through the BOP with an adapter 26 consisting of an outer annular body part 27 and an inner annular gland nut 28 which has a screw threaded connection to the body 27 so that it can be screwed between a lowered position shown on the right hand side of FIG. 1A, in which radial ducts 29 and 30, respectively in the body 27 and nut 28, are in communication with one another, and a raised position shown on the left hand side of FIG. 1A, in which the ducts are out of communication with one another. The duct 29 communicates through a conduit 31 between a depending portion of the body 27 and the housing 20, and through a conduit 32 passing through the production casing hanger 21, to the annulus surround the production casing. The duct 30 communicates through channels 33 formed in the radially inner surface of the nut 28, and hence to a void to be described. The cooperation between the gland nut 28 and body 27 of the adapter therefore acts as a valve which can open and close a passage up past the production casing hanger from the production casing annulus. After appropriate testing, a tool is run in through the BOP and, by means by radially projecting spring lugs engaging in the channels 33, rotates the gland nut 28 to the valve closed position shown on the right hand side on FIG. 1A. The well is thus resealed and the drilling BOP 22 can temporarily be removed.

Figure 2:
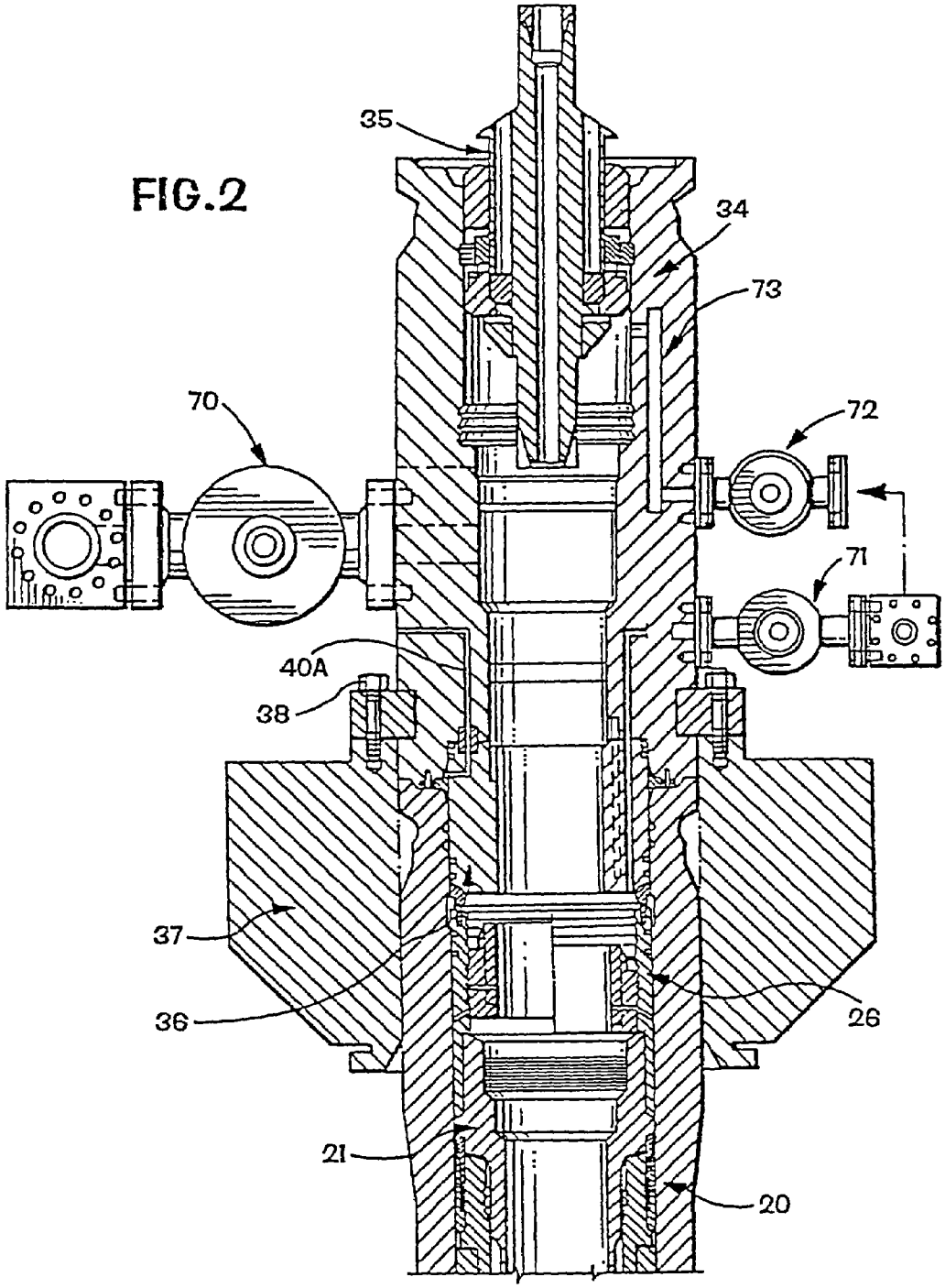
Figure 2A:
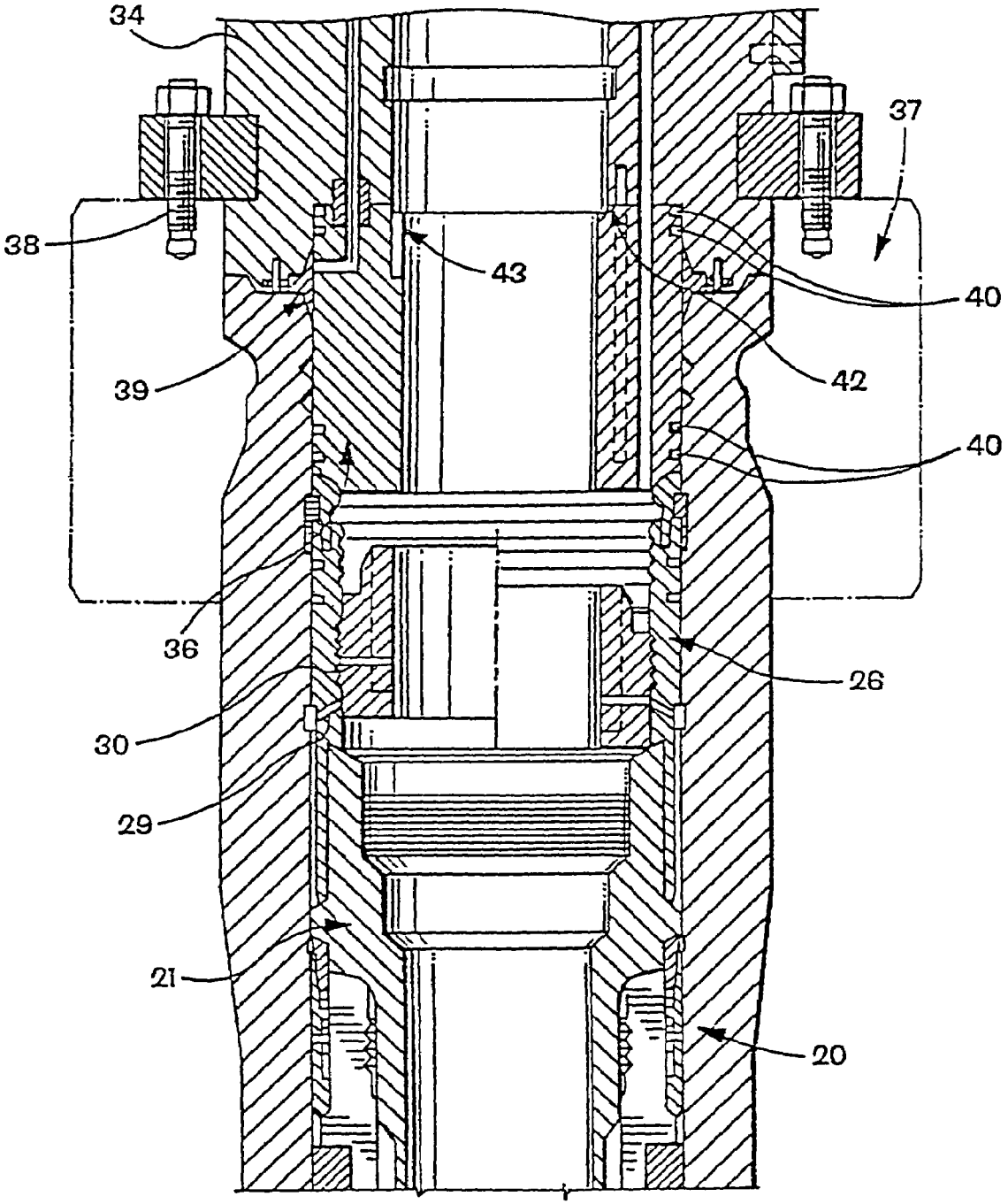

As shown in FIGS. 2 and 2A, the body of a tree spool 34 is then lowered on a tree installation tool 35, using conventional guide post location, or a guide funnel in case of deep water, until a spool tree mandrel 36 is guided into alignment with and slides as a close machined fit, into the upper end of the wellhead housing 20, to which the spool tree is then fixed via a production connector 37 and bolts 48. The mandrel 36 is actually a separate part which is bolted and sealed to the rest of the spool tree body. As seen particularly in FIG. 2A a weight set AX gasket 39, forming a metal to metal environmental seal is provided between the spool tree body and the wellhead housing 20. In addition two sets of sealing rings 40 provide, in series with the environmental seal, a production fluid seal externally between the ends to the spool tree mandrel 36 to the spool tree body and to the wellhead housing 20. The intervening cavity can be tested through a test part 4OA. The provision of the adapter 26 is actually optional, and in its absence the lower end of the spool tree mandrel 36 may form a production seal directly with the production casing hanger 21. As is also apparent from reasons which will subsequently become apparent, the upper radially inner edge of the spool tree mandrel projects radially inwardly from the inner surface of the spool tree body above, to form a landing shoulder 42 and at least one machined key slot 43 is formed down through the landing shoulder.

Figure 3:
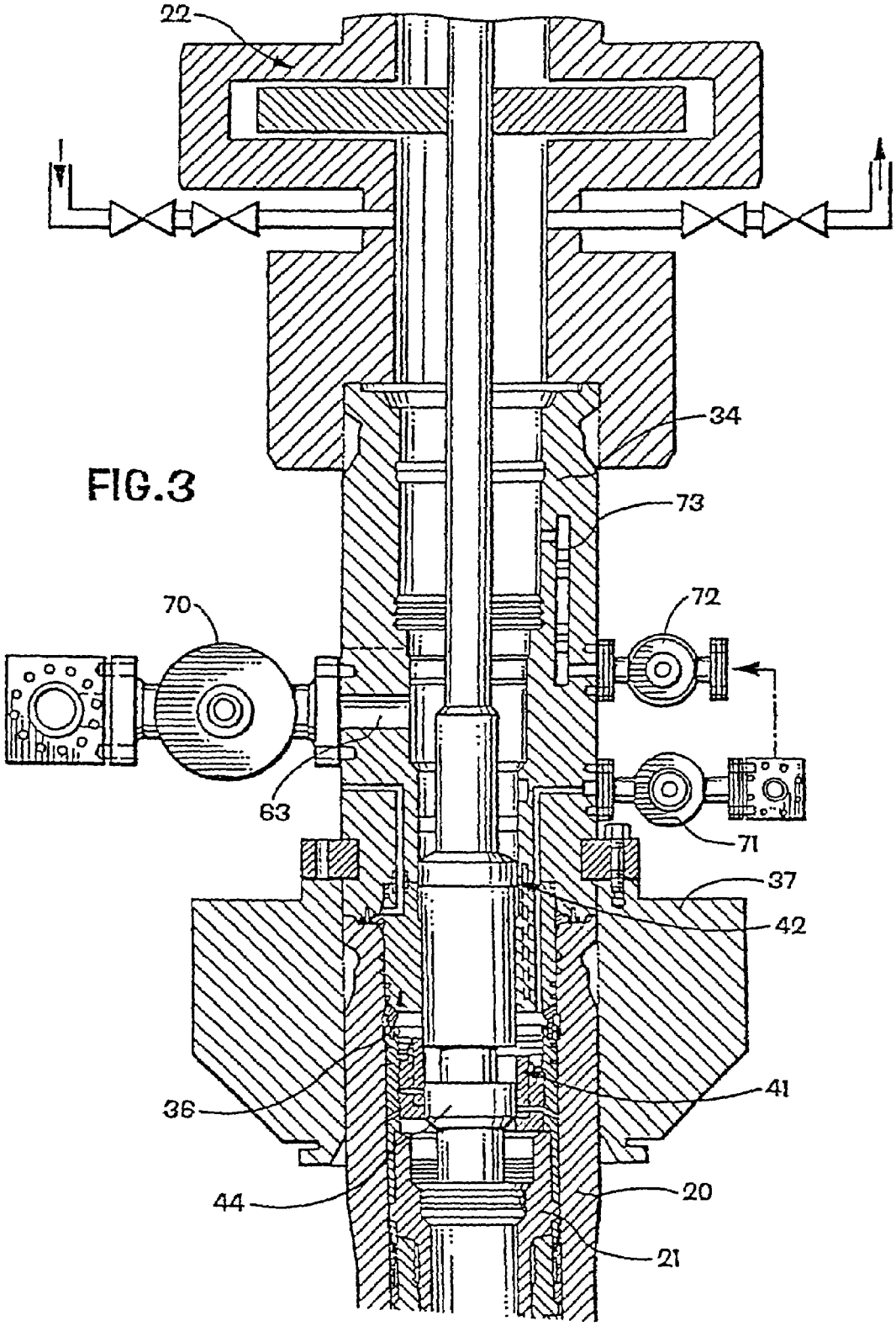

As shown in FIG. 3, the drilling BOP 22 is reinstalled on the spool tree 34. The tool 44 used to set the adapter in FIG. 1, having the spring dogs 45, is again run in until it lands on the shoulder 42, and the spring dogs 45 engage in the channels 33. The tool is then turned to screw the gland nut 28 down within the body 27 of the adapter 26 to the valve open position shown on the right hand side in FIG. 1A. It is now safe to open the production casing annulus as the well is protected by the BOP.

Figure 4:
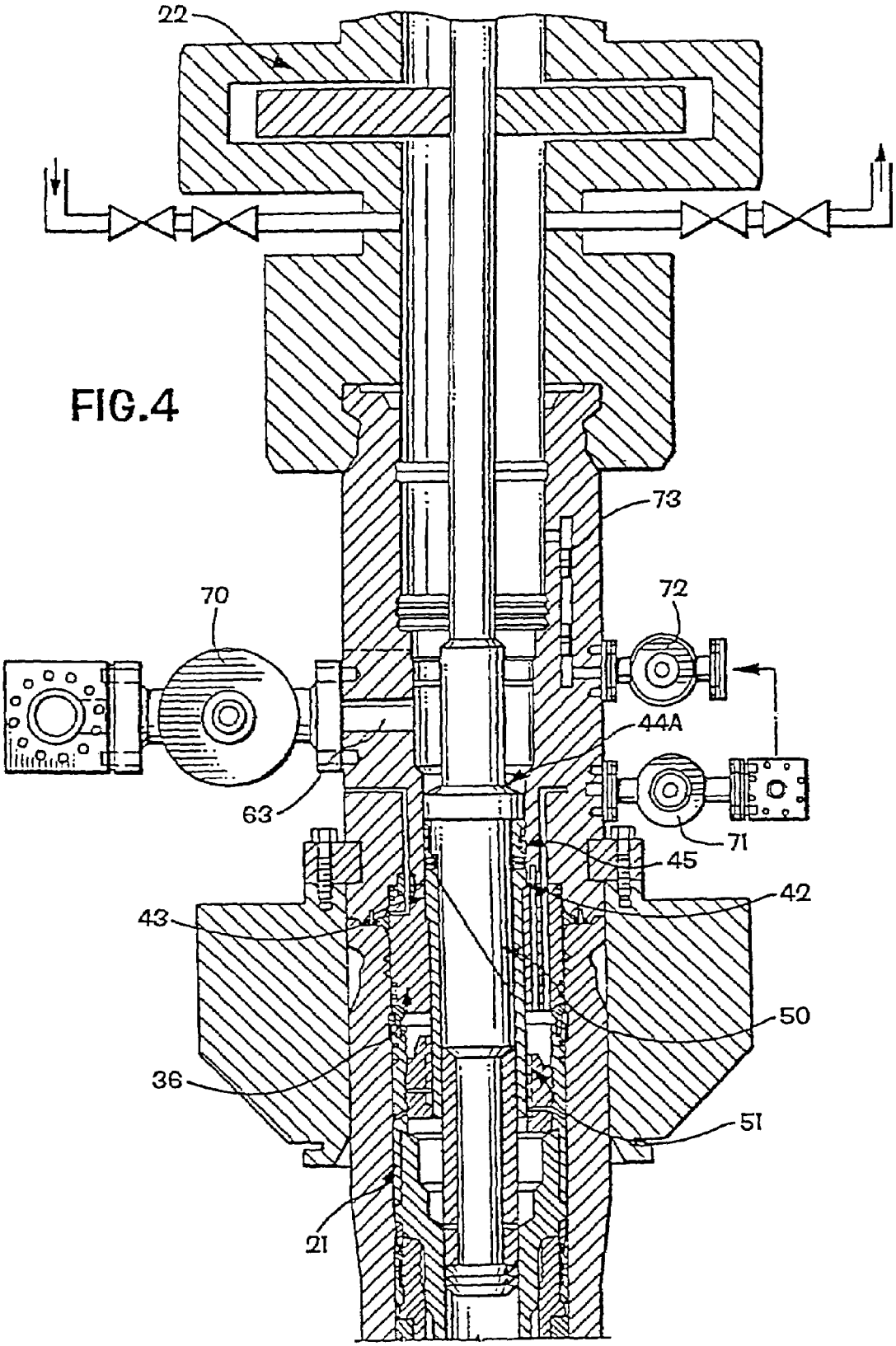
Figure 4A:
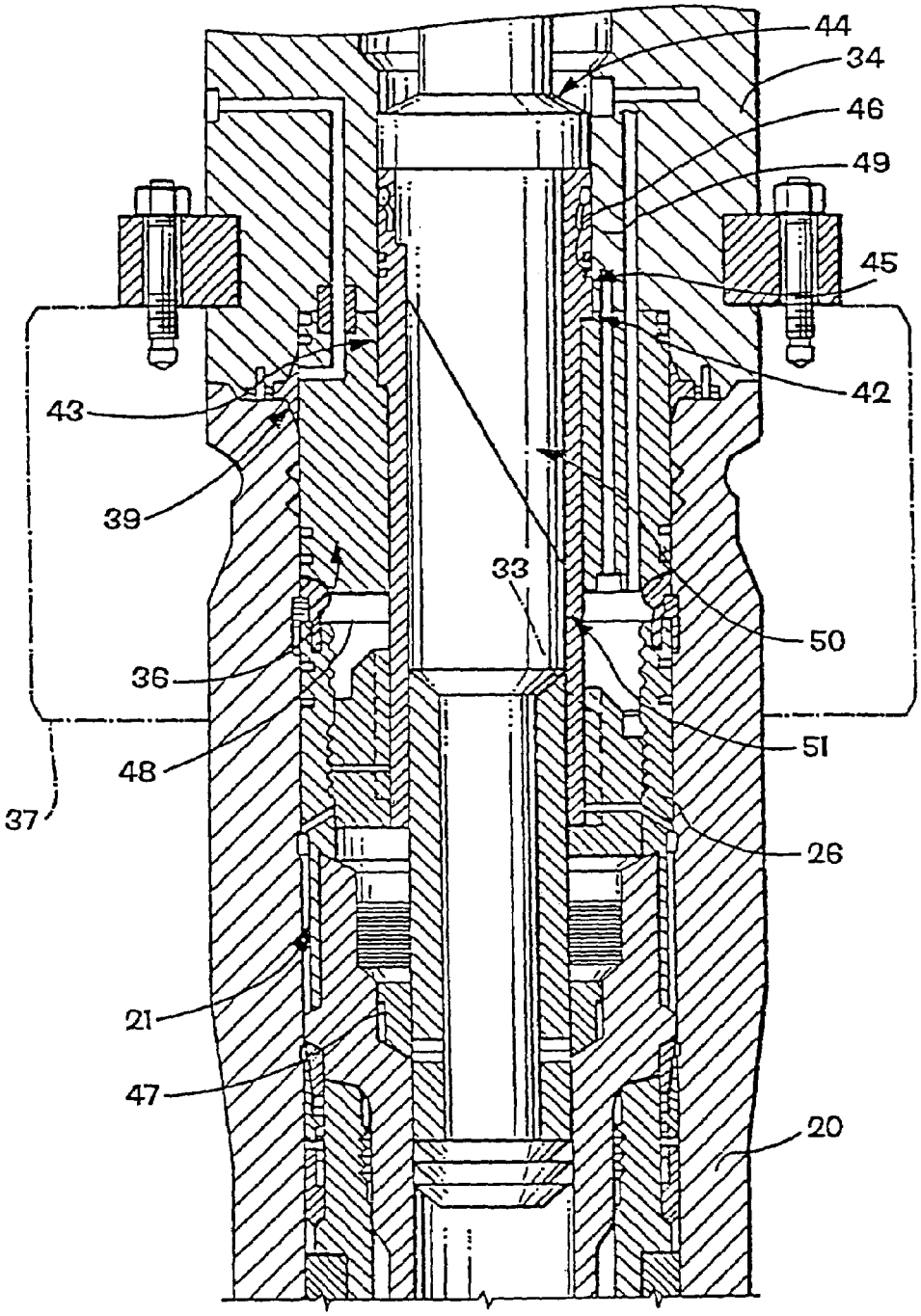

The next stage, shown in FIGS. 4 and 4A, is to run in through the BOP and spool tree on an appropriate tool 44A a combined isolation and orientation sleeve 45. This lands on the shoulder 42 at the top of the spool tree mandrel and is rotated until a key on the sleeve drops into the mandrel key slot 43. This ensures precise angular orientation between the sleeve 45 and the spool tree 44, which is necessary, and in contrast to the angular orientation between the spool tree 34 and the wellhead casing, which is arbitrary. The sleeve 45 consists of an external cylindrical portion, an upper external surface of which is sealed by ring seals 46 to the spool tree 34, and the lower external surface of which is sealed by an annular seal 47 to the production casing hanger 21. There is thus provided between the sleeve 45 and the surrounding wellhead casing 20 a void 48 with which the channels 33, now defined radially inwardly by the sleeve 45, communicate. The void 48 in turn communicates via a duct 49 through the mandrel and body of the spool tree 34 to a lateral port. It is thus possible to monitor and vent the pressure in the production casing annulus through the passage provided past the production casing hanger via the conduits 32, 31 the ducts 29 and 30, the channels 33, shown in FIG. 1A, the void 48, the duct 49, and the lateral port in the spool tree. In the drawings, the radial portion of the duct 49 is shown apparently communicating with a tubing annulus, but this is draftsman's license and the ports from the two annuli are, in fact, angularly and radially spaced.

Within the cylindrical portion of the sleeve 45 is a lining, which may be fixed in the cylindrical portion, or left after internal machining of the sleeve. This lining provides an orientation sleeve having an upper/edge forming a cam 50. The lowermost portion of the cam leads into a key slot 51.

Figure 5:
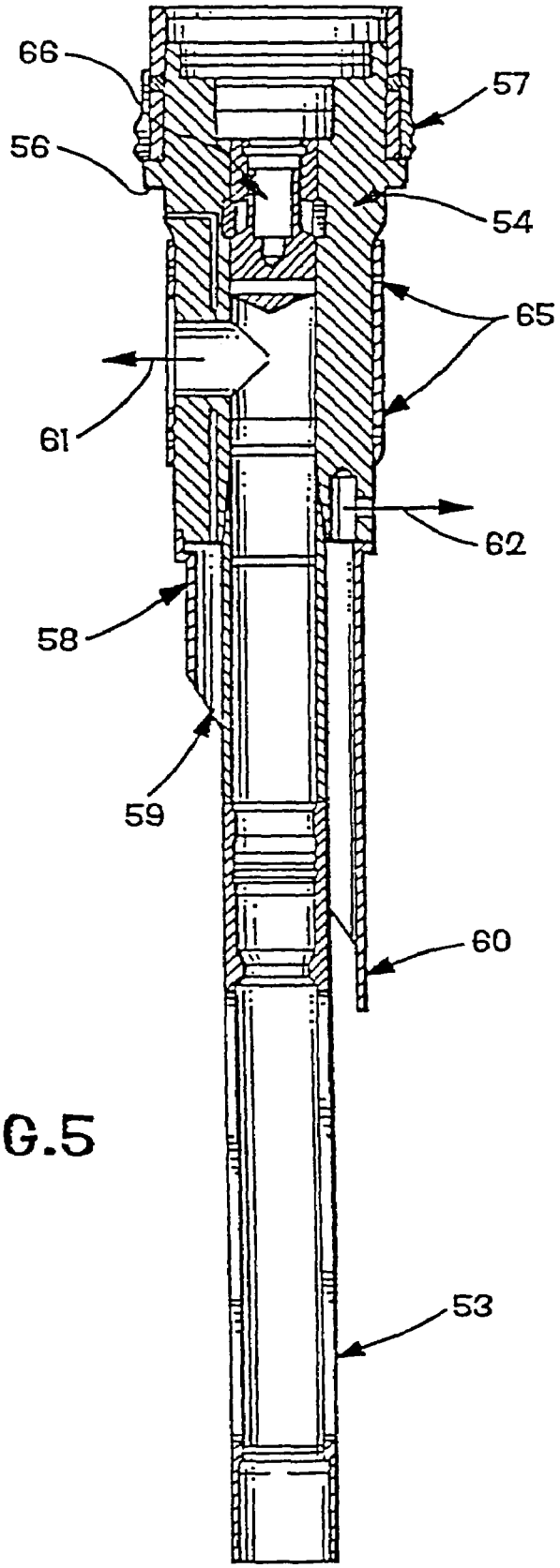
Figure 6:
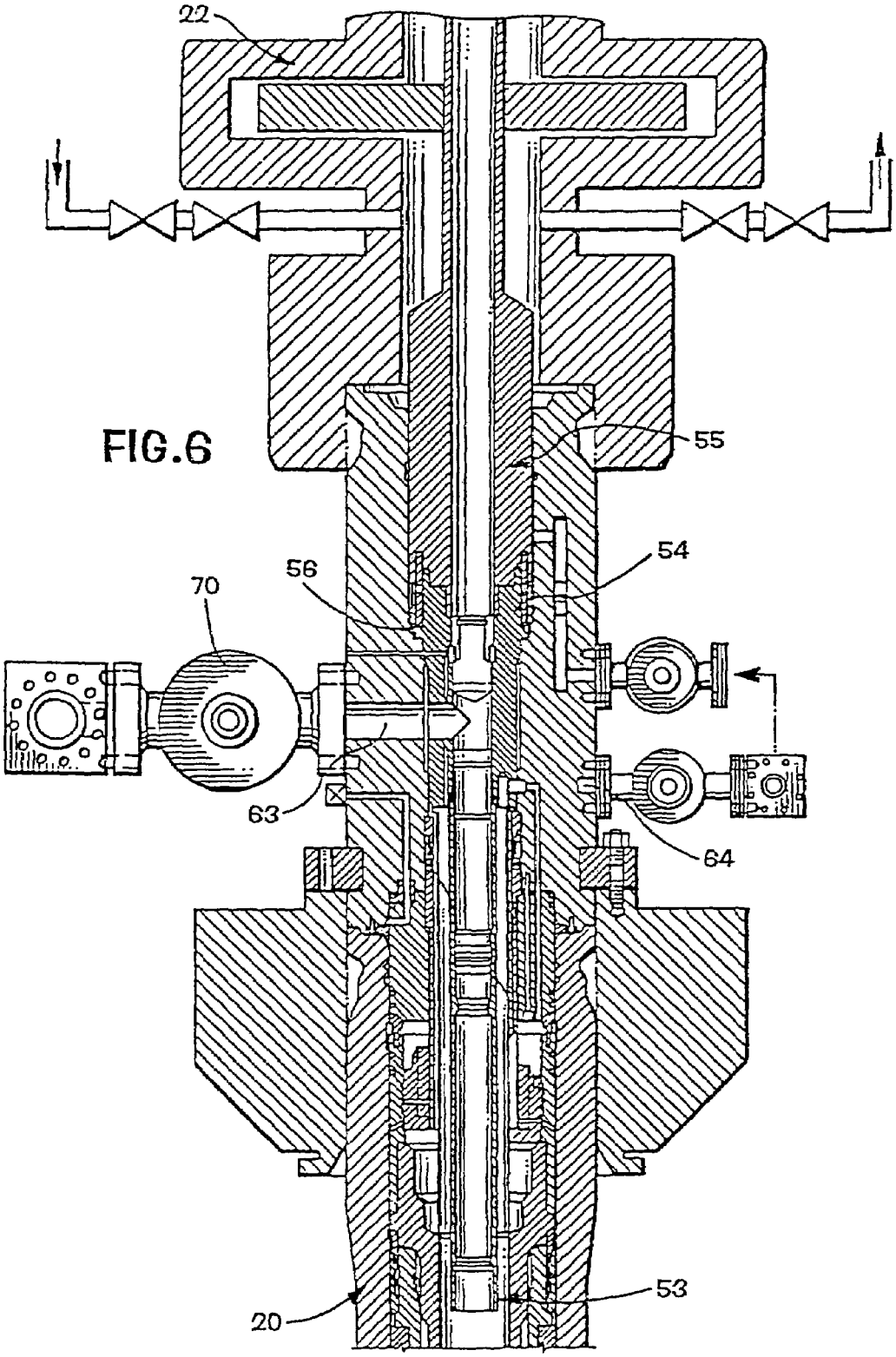
Figure 6A:
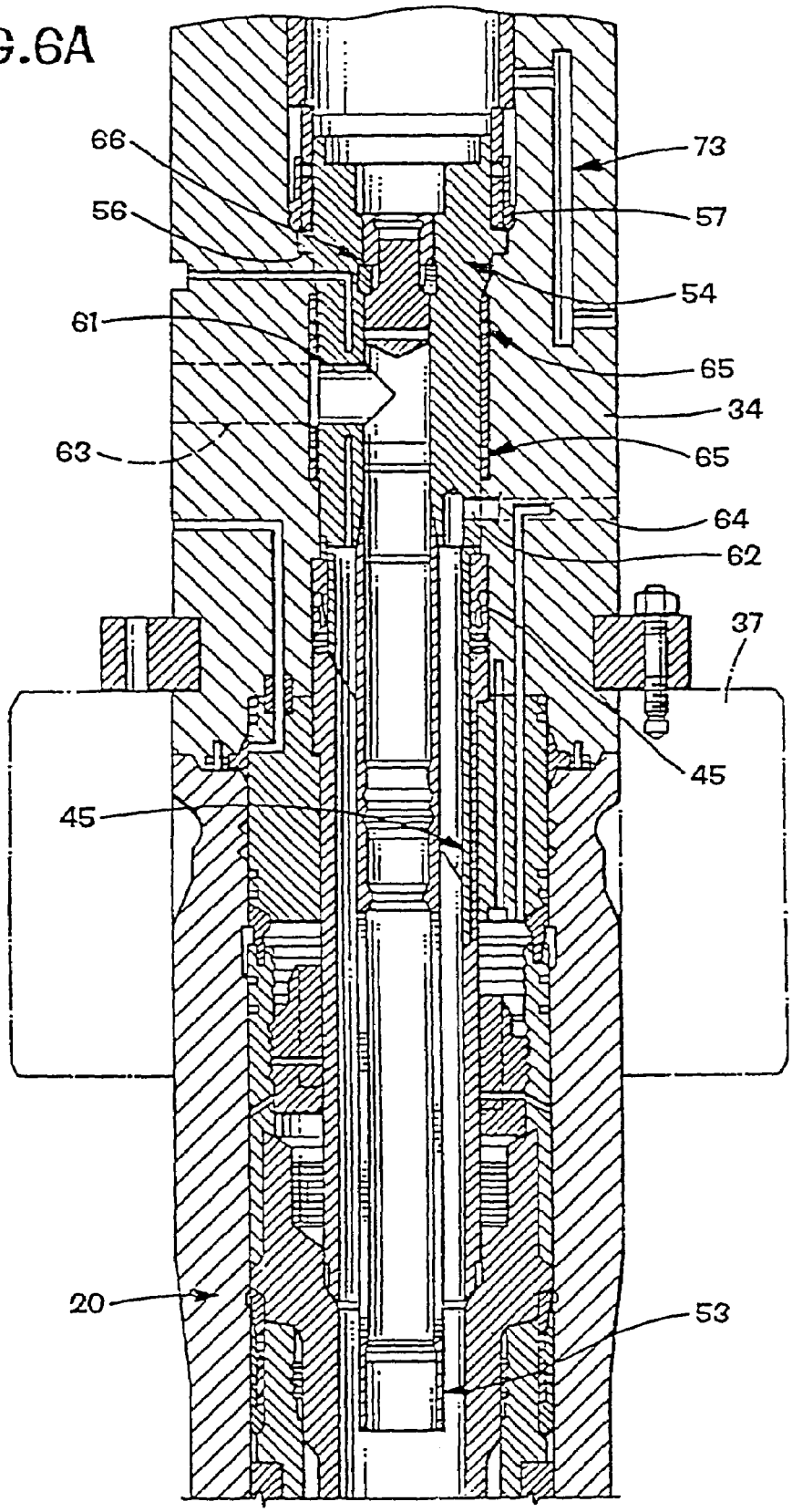

As shown in FIGS. 5, 6 and 6A a tubing string of production tubing 53 on a tubing hanger 54 is run in through the BOP 22 and spool tree 34 on a tool 55 until the tubing hanger lands by means of a keyed shoulder 56 on a landing in the spool tree and is locked down by a conventional mechanism 57. The tubing hanger 54 has a depending orientation sleeve 58 having an oblique lower edge forming a cam 59 which is complementary to the cam 50 in the sleeve 45 and, at the lower end of the cam, a downwardly projecting key 60 which is complementary to the key slot 51. The effect of the cams 50 and 59 is that, irrespective of the angular orientation of the tubing string as it is run in, the cams will cause the tubing hanger 54 to be rotated to its correct angular orientation relatively to the spool tree and the engagement of the key 60 in the key slot 51 will lock this relative orientation between the tubing hanger and spool tree, so that lateral production and tubing annulus fluid flow ports 61 and 62 in the tubing hanger 54 are in alignment with respective lateral production and tubing annulus fluid flow ports 63 and 64 through the wall of the spool tree. Metal to metal annulus seals 65, which are set by the weight of the tubing string, provide production fluid seals between the tubing hanger 54 and the spool tree 34. Provision is made in the top of the tubing hanger 54 for a wireline set plug 66. The keyed shoulder 56 of the tubing hanger lands in a complementary machined step in the spool tree 34 to ensure ultimate machined accuracy of orientation between the tubing hanger 54 and the spool tree 34.

Figure 7:
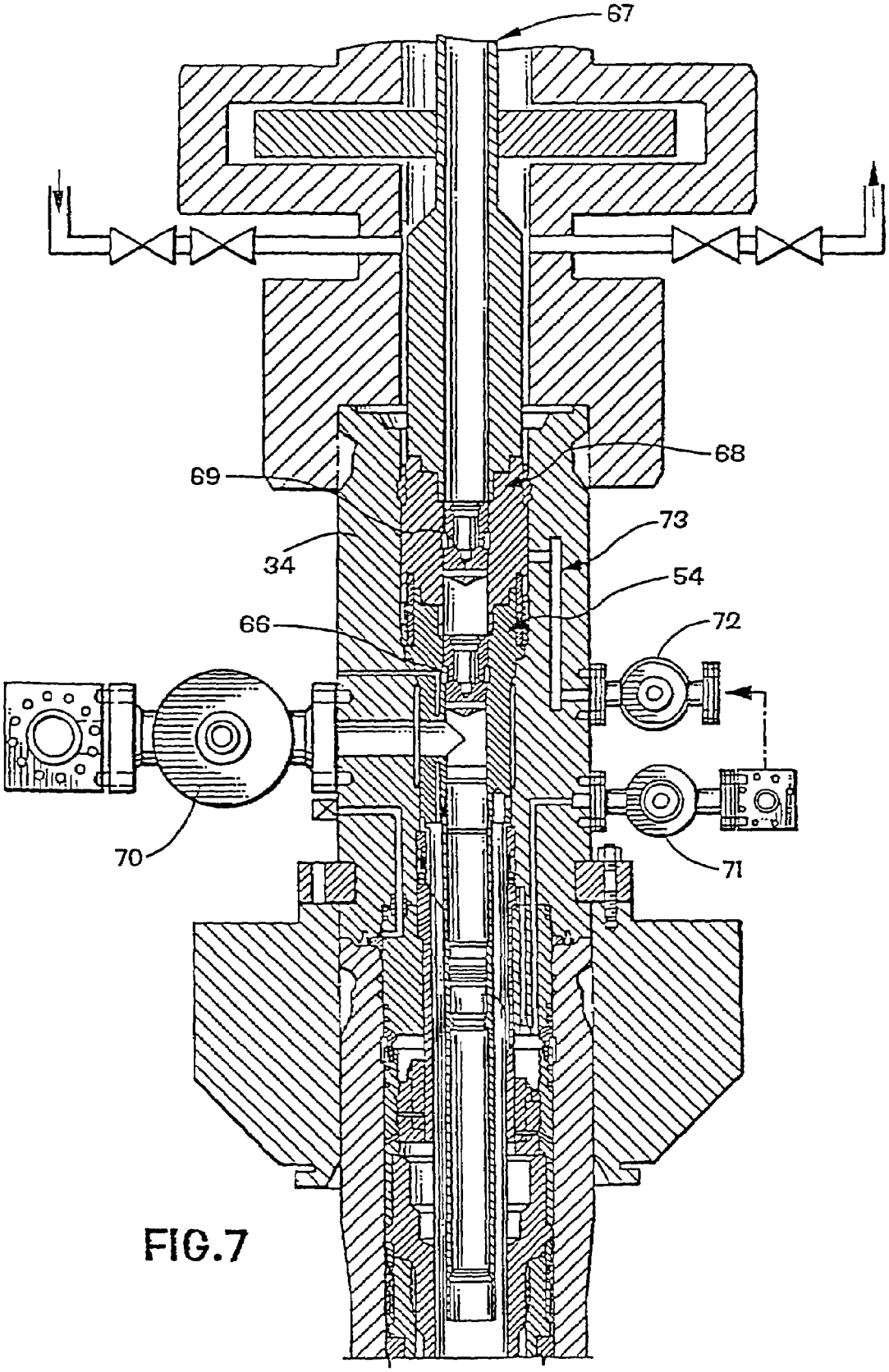

FIG. 7 shows the final step in the completion of the spool tree. This involves the running down on drill pipe 67 through the BOP, an internal isolation stopper 68 which seals within the top of the spool tree 34 and has an opening closed by an in situ wireline activated plug 69. The BOP can then be removed leaving the wellhead in production mode with double barrier isolation at the upper end of the spool tree provided by the plugs 66 and 69 and the stopper 68. The production fluid outlet is controlled by a master control valve 70 and pressure through the tubing annulus outlet ports 62 and 64 is controlled by an annulus master valve 71. The other side of this valve is connected, through a workover valve 72 to a lateral workover port 73 which extends through the wall of the spool tree to the void between the plugs 69 and 66. With this arrangement, wireline access to the tubing annulus in and downstream of a tubing hanger is unnecessary as any circulation of fluids can take place through the valves 71 and 72, the ports 62, 64 and 73, and the kill or choke lines of any BOP which has been installed. The spool tree in the completed production mode is shown in FIG. 8.

Figure 9:
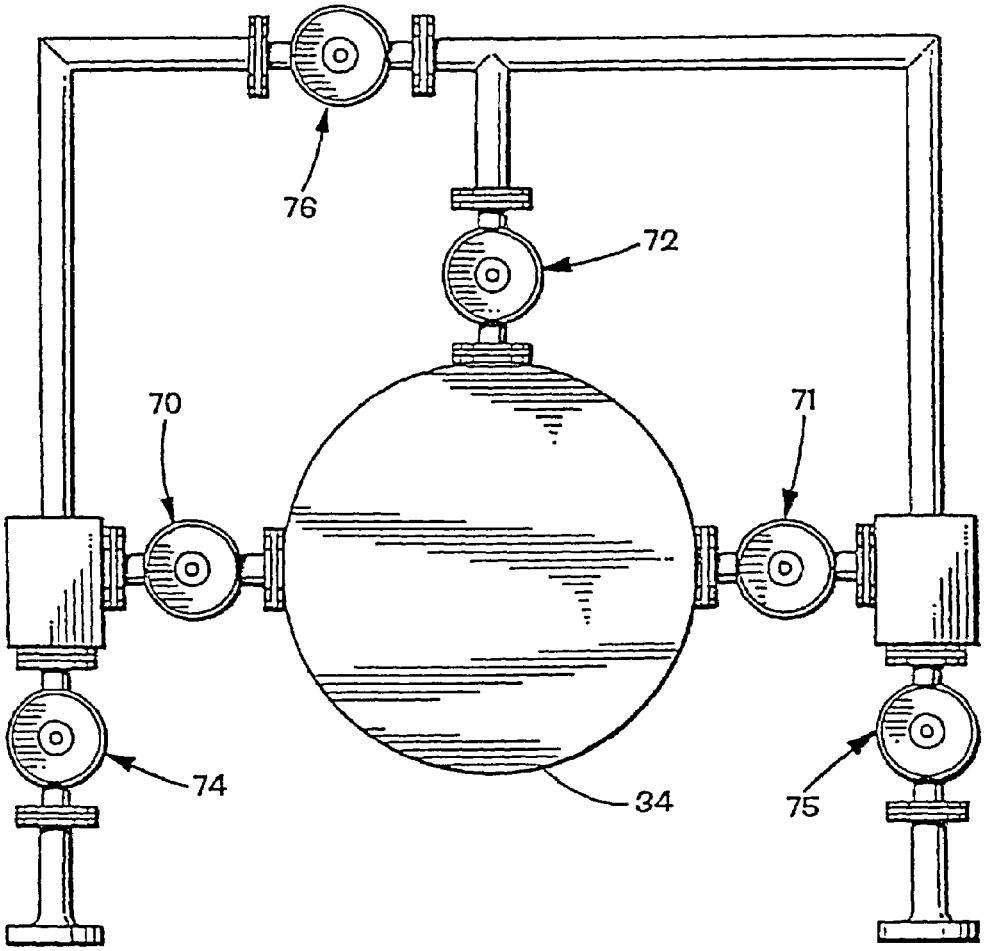
FIG. 9 is a circuit diagram showing external connections to the spool 3.

FIG. 9 shows valve circuitry associated with the completion and, in addition to the earlier views, shows a production fluid isolation valve 74, a tubing annulus valve 75 and a cross over valve 76. With this arrangement a wide variety of circulation can be achieved down hole using the production bore and tubing annulus, in conjunction with choke and kill lines extending from the BOP and through the usual riser string. All the valves are fail/safe closed if not actuated.

The arrangement shown in FIGS. 1 to 9 is a mono production bore wellhead which can be accessed by a single wireline or drill pipe, and the external loop from the tubing annulus port to the void between the two plugs at the top of the spools tree avoids the need for wireline access to the tubing annulus bore.

Figure 8:
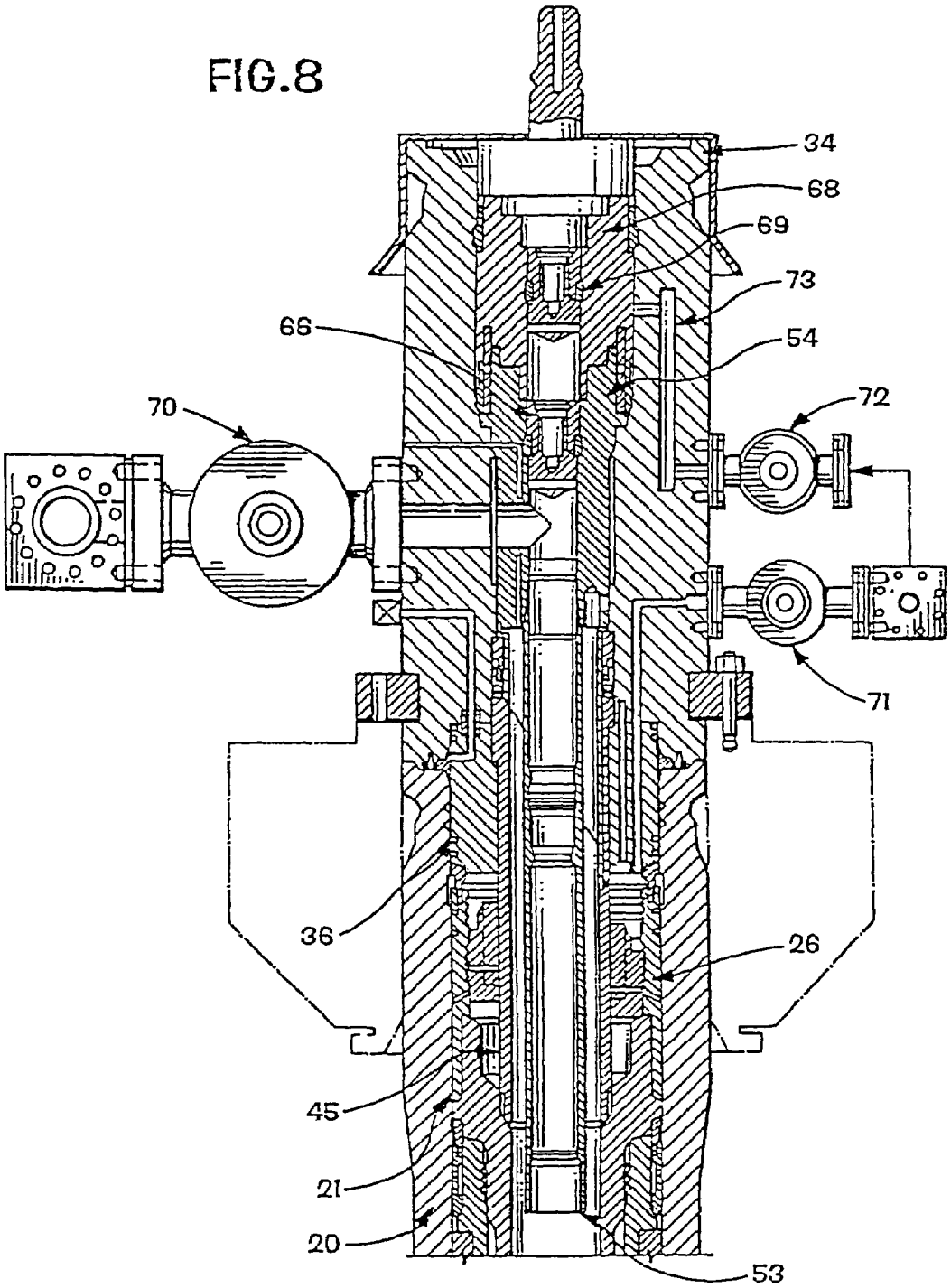
Figure 10:
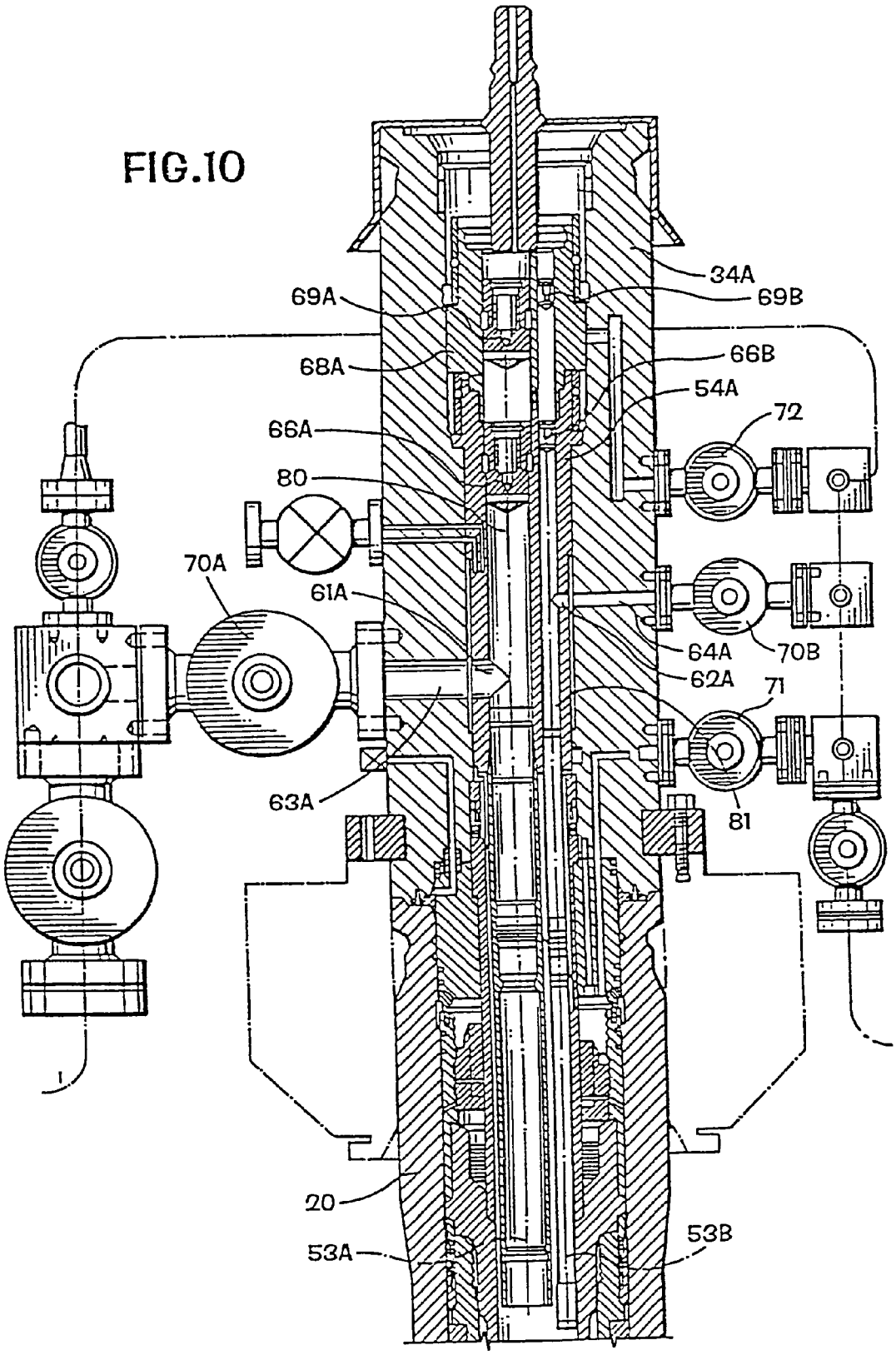
FIG. 10 is a vertical axial section through a completed dual production bore well in production mode.

FIG. 10 corresponds to FIG. 8 but shows a 5½ inch×2⅜ inch dual production bore wellhead with primary and secondary production tubing 53A and 53B. Development and completion are carried out as with the monobore wellhead except that the spool tree 34A and tubing hanger 54A are elongated to accommodate lateral outlet ports 61A, 63A for the primary production fluid flow from a primary bore 80 in the tubing hanger to a primary production master valve 70A, and lateral outlet ports 62A, 64A for the secondary production fluid flow from a secondary bore 81 in the tubing hanger to a secondary production master valve 70B. The upper ends of the bores 80 and 81 are closed by wireline plugs 66A and 66B. A stopper 68A, which closes the upper end of the spool tree 34A has openings, in alignment with the plugs 66A and 66B, closed by wireline plugs 69A and 69B.

Figure 13:
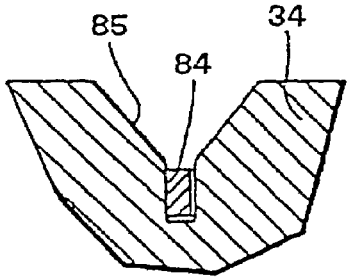
Figure 13A:
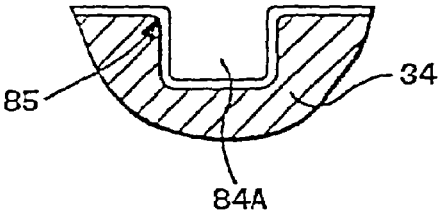
Figure 13B:
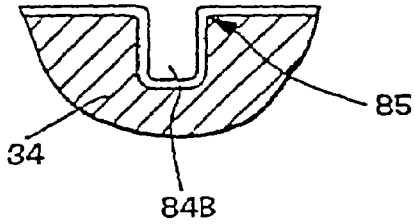
Figure 11:
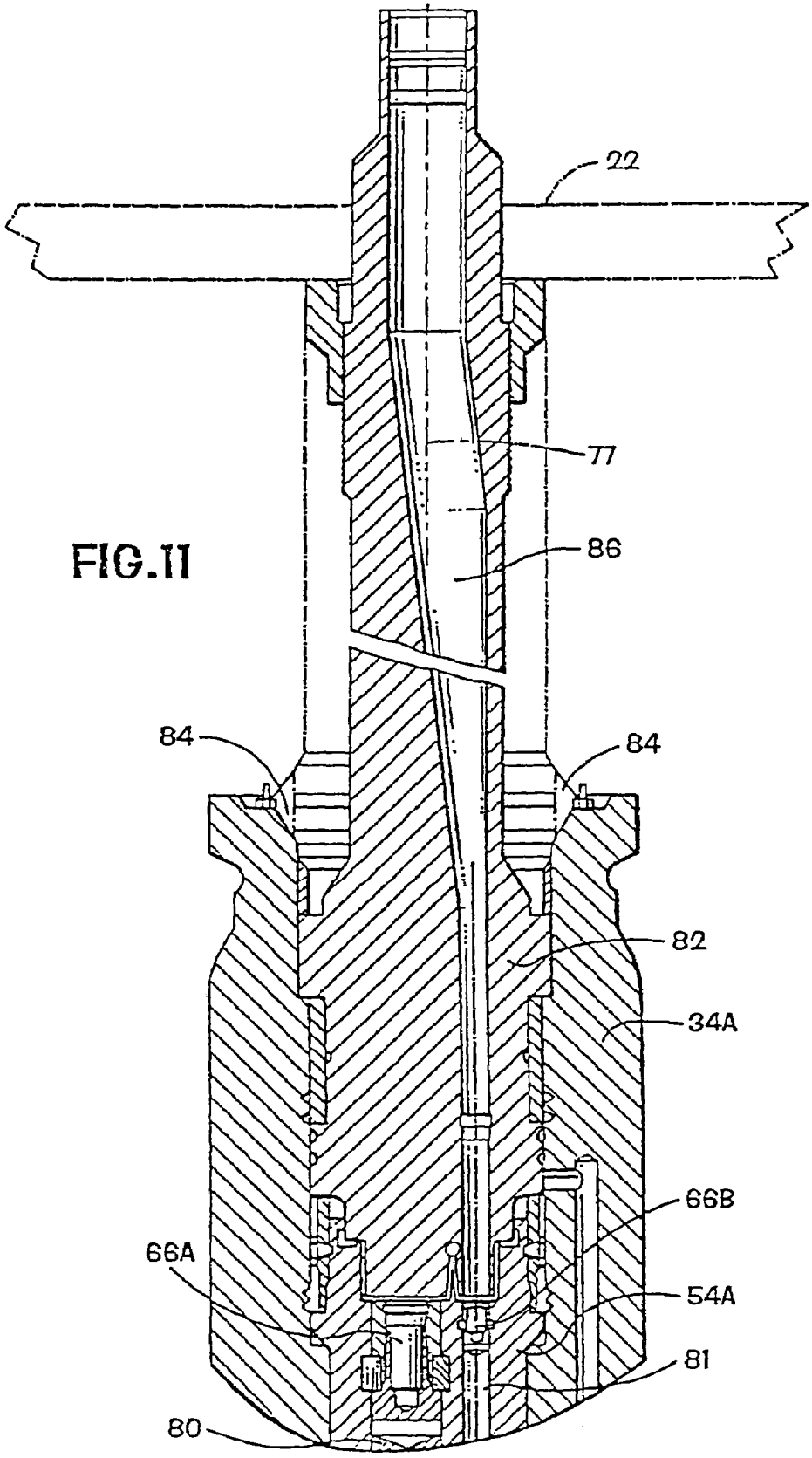
FIGS. 11 and 12 are vertical axial sections showing alternative connectors to the upper end of the dual production bore wellhead during work over; and, FIG. 13 is a detail showing the seating of one of the connectors in the spool tree.
Figure 12:
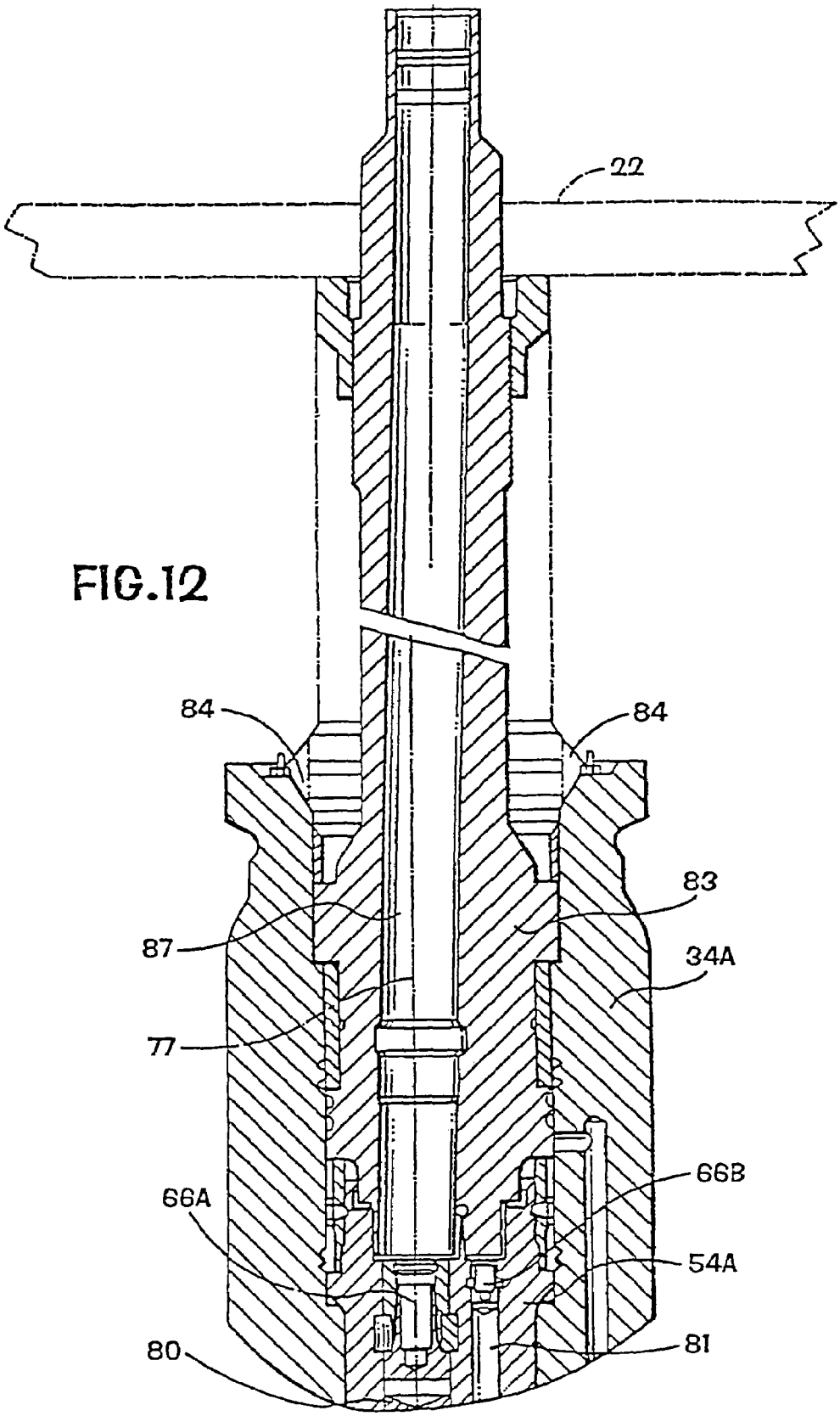

FIGS. 11 and 12 show how a wireline 77 can be applied through a single drill pipe to activate selectively one or other of the two wireline plugs 66A and 66B in the production bores 80 and 81 respectively. This involves the use of a selected one of two connectors 82 and 83. In practice, a drilling BOP 22 is installed and the stopper 68A is removed. Thereafter the connector 82 or 83 is run in on the drill pipe or tubing until it lands in, and is secured and sealed to the spool tree 34A. FIG. 13 shows how the correct angular orientation between the connector 82 or 83 and the spool tree 34A, is achieved by wing keys 84, which are guided by Y-shaped slots 85 in the upper inner edge of the spool tree, first to bring the connectors into the right angular orientation, and then to allow the relative axial movement between the parts to enable the stabbing function when the wireline connector engages with its respective pockets above plug 66A or 66B. To ensure equal landing forces and concentricity on initial contact, two keys 84A and 84B are recommended. As the running tool is slowly rotated under a new control weight, it is essential that the tool only enters in one fixed orientation. To ensure this key 84A is wider than key 84B and its respective Y-shaped slots. It will be seen that one of the connectors 82 has a guide duct 86 which leads the wireline to the plug 66B whereas the other connector 83 has a similar guide duct 87 which leads the wireline to the other plug 66A.

What is claimed is:

1. A flow completion system for controlling the flow of fluid from a well bore, the flow completion system comprising:

a tubing spool which includes a central bore that extends axially therethrough and a production outlet which communicates with the central bore;

an assembly which is supported in the central bore and which includes a vertical bore that extends axially therethrough and a tubing hanger having a production passageway that communicates between the vertical bore and the production outlet, the tubing hanger supporting a tubing string which extends into the well bore and defines a tubing annulus surrounding the tubing string;

a first closure member positioned in the vertical bore above the production passageway;

a first seal positioned between the tubing hanger and the tubing spool above the production passageway;

wherein the first closure member and the first seal comprise a first pressure-containing barrier between the well bore and a surrounding environment;

a second closure member which is positioned in the vertical bore above the first closure member; and a second seal which is disposed on the assembly and positioned within the tubing spool above the first seal;

wherein the second closure member and the second seal comprise a second pressure-containing barrier between the well bore and the environment; and wherein both the first and the second barriers are associated with the assembly.

2. The flow completion system of claim 1 wherein the assembly includes a stopper member having the second seal supported in the central bore above the tubing hanger and through which passes the vertical bore.

3. The flow completion system of claim 1, wherein the first and second closure members each comprise a wireline deployable plug.

4. The flow completion apparatus of claim 1, wherein the first closure member comprises a first sealing member which is mounted on a wireline deployable plug body and the second closure member comprises a second sealing member which is mounted on a wireline deployable plug body above the first sealing member.

5. The flow completion system of claim 1, further comprising:

an ancillary bore which extends generally axially through the assembly from a lower end to an upper end of the assembly; and an ancillary closure member which is positioned in the ancillary bore.

6. The flow completion system of claim 5, wherein:

a generally lateral branch extending from the ancillary bore through walls of the tubing hanger and tubing spool to a valve that is moveable to open and close the lateral branch.

7. The flow completion system of claim 1 further comprising a tree cap which comprises:

an annular body; and means for securing the body to the tubing spool.

8. The flow completion system of claim 5, further comprising a connector with a seal stab for engaging the ancillary bore.

9. The flow completion system of claim 8, wherein the connector further comprises:

a fluid bore extending through the connector and which is adapted to be connected to a conduit; and the fluid bore communicating with a bore in the seal stab;

wherein fluid communication may be established between the ancillary bore and the conduit through the seal stab.

10. The flow completion system of claim 1, further comprising:

a blowout preventer which is removably connectable to the top of the tubing spool and which includes a blowout preventer bore, a set of blowout preventer rams, and at least one choke and kill line that communicates with a portion of the blowout preventer bore which is located adjacent the blowout preventer rams; and a tubing hanger tool which is removably connectable to the top of the assembly and which includes a cylindrical outer surface portion and a flowbore that communicates with the vertical bore;

an annulus passageway which communicates the tubing annulus with the outer surface portion;

wherein the blowout preventer rams are adapted to sealingly engage the outer surface portion above the annulus passageway;

whereby fluid communication between the tubing annulus and the blowout preventer choke and kill line may be established through the annulus passageway and the portion of the blowout preventer bore which is located below the blowout preventer rams.

11. The flow completion apparatus of claim 1, further comprising:

a tubing hanger tool which is removably connectable to the top of the assembly in a predetermined orientation;

the tubing hanger tool including a flow passageway therethrough and being sealed to the tubing spool; and the tubing hanger tool having stabs received by the vertical bore and the ancillary bore in the assembly.

12. The flow completion apparatus of claim 11 wherein the flow passageway extends through one of the stabs for flow communication with the vertical bore or ancillary bore.

13. The flow completion assembly of claim 1 further comprising an offset vertical bore which extends generally axially through the tubing hanger and an offset vertical bore closure member which is positioned in the offset vertical bore.

14. The flow completion assembly of claim 13, wherein the offset vertical bore is connected to a generally lateral passageway.

15. The flow completion assembly of claim 1, wherein the assembly includes an annular stopper member and means for securing the stopper member to the tubing spool.

16. The flow completion assembly of claim 15, wherein the stopper member further comprises a seal stab for insertion into an offset bore which extends through the tubing hanger.

17. The flow completion assembly of claim 1 wherein the tubing spool comprises an annulus outlet and an annulus passageway which extends between the tubing annulus and the annulus outlet and wherein the tubing spool comprises a workover passageway which extends between the annulus passageway and a portion of the central bore that is located above the first seal.

18. The flow completion system of claim 17, further comprising:

a connector on a pipe string which is removably connectable to the assembly and which includes a generally tubular body and a production port that extends axially through the body and communicates with the vertical bore;

a BOP which is removably connectable to the top of the tubing spool and which includes a BOP bore, a set of BOP rams, and at least one choke and kill line that communicates with a portion of the BOP bore that is located below the BOP rams;

wherein the BOP rams are adapted to sealingly engage the connector; and wherein fluid communication between the tubing annulus and the BOP choke and kill line may be established through the annulus passageway, the workover passageway and the portion of the BOP bore which is located below the BOP rams.

19. The flow completion assembly of claim 18, wherein the connector further comprises an offset port that communicates with an offset vertical bore which extends generally axially through the tubing hanger, the offset port communicating with the pipe string.

20. The flow completion assembly of claim 18, wherein the BOP rams are adapted to sealingly engage an outer surface portion of the connector, and wherein fluid communication between the tubing annulus and the BOP choke and kill line may be established through the annulus passageway, the workover passageway, and the portion of the BOP bore which is located below the first BOP rams.

21. The flow completion system of claim 1, wherein each of the first and second pressure-containing barriers isolates both the vertical bore and the tubing annulus from a portion of the central bore that is located above the tubing hanger.

22. The flow completion system of claim 21, wherein the tubing spool comprises an annulus outlet and an annulus passageway which provides for fluid communication between the tubing annulus and the annulus outlet; and wherein the tubing spool comprises a workover passageway which provides for fluid communication between the annulus passageway and a portion of the central bore that is located above the first pressure-containing barrier.

23. The flow completion system of claim 1, wherein the tubing spool comprises an annulus outlet and an annulus passageway which extends between the tubing annulus and the annulus outlet; and wherein the tubing spool comprises a workover passageway which extends between the annulus passageway and a portion of the central bore that is located above the first seal.

24. The flow completion system of claim 1, further comprising a crossover line which is fluidly connected between the production outlet and the annulus outlet, wherein fluid communication between the vertical bore and the tubing annulus may be established through the production passageway, the production outlet, the crossover line and the annulus passageway.

25. The flow completion system of claim 1, further comprising:

a BOP which is removably connectable to the top of the tubing spool and which includes a BOP bore, a set of BOP rams, and at least one choke and kill line that communicates with a portion of the BOP bore which is located below the BOP rams; and a connector on a pipe string which is removably connectable to the top of the assembly and which includes a cylindrical outer surface portion, a production port that communicates with the vertical bore, and an offset port with an offset vertical bore which extends generally axially through the tubing hanger, the offset port communicating with the pipe string;

wherein the BOP rams are adapted to sealingly engage the outer surface portion above the offset port; and wherein fluid communication between the tubing annulus and the BOP choke and kill line may be established through the annulus passageway, workover passageway, and the portion of the BOP bore which is located below the first BOP rams.

26. The flow completion system of claim 1, further comprising:

an offset bore which extends generally axially through the tubing hanger between the tubing annulus and a portion of the central bore that is located above the second seal; and an offset closure member which is positioned in the offset bore;

wherein the offset bore is used for workover.

27. The flow completion system of claim 1 wherein the tubing spool comprises an annulus outlet and an annulus passageway which extends between the tubing annulus and the annulus outlet and further comprising a crossover line which is fluidly connected between the production outlet and the annulus outlet, wherein fluid communication between the vertical bore and the tubing annulus may be established through the production passageway, the production outlet, the crossover line and the annulus passageway.

28. The flow completion system of claim 1, wherein the first and second seals are metal seals positioned between the assembly and the tubing spool.

29. The flow completion system of claim 1, wherein the tubing hanger has at least two service and control conduits which each extend through the tubing hanger to the tubing annulus.

30. The flow completion system of claim 1, wherein the assembly includes an offset bore which extends generally axially through the assembly between the tubing annulus and a portion of the central bore that is located above the second seal;

a first offset closure member which is positioned in the offset bore; and a second offset closure member which is positioned in the offset bore.

31. The flow completion system of claim 1, further including a connector on a pipe string which is removably connectable to the top of the assembly and which includes a production port that communicates with the vertical bore or an offset port that communicates with an offset bore that extends generally axially through the assembly;

wherein the tubing spool comprises an annulus passageway that communicates with the tubing annulus and a workover passageway that extends between the annulus passageway and the central bore;

a BOP which is removably connectable to the top of the tubing spool and which includes a BOP bore and at least one choke and kill line that communicates with the BOP bore;

wherein the workover port communicates with the BOP bore;

whereby fluid communication between the tubing annulus and the BOP choke and kill line may be established through the BOP bore, the workover passageway and the annulus passageway.

32. The flow completion system of claim 1, further including a connector on a pipe string which is removably connectable to the top of the assembly and which includes a production port that communicates with the vertical bore and an offset port that communicates with an offset bore extending through the assembly that communicates with the tubing annulus;

wherein the offset port communicates with the tubing annulus through the offset bore;

a BOP which is removably connectable to the top of the tubing spool and which includes a BOP bore and at least one choke and kill line that communicates with the BOP bore;

wherein the offset port communicates with the pipe string;

whereby workover may be performed through the offset port and offset bore.

33. The flow completion system of claim 1, wherein the assembly includes an annular stopper member, means for securing the stopper member to the tubing spool, and a seal stab on the stopper member for insertion into that portion of the vertical bore which extends through the tubing hanger.

34. The flow completion system of claim 1, further including a BOP which is removably connectable to the top of the tubing spool and which includes a BOP bore, a set of BOP rams, and at least one choke and kill line that communicates with a portion of the BOP bore which is located below the BOP rams; and a connector on a pipe string which is removably connectable to the top of the assembly and which includes a cylindrical outer surface portion, a production port that communicates with the vertical bore or an offset port that communicates with an offset bore that extends through the tubing hanger;

wherein the BOP rams are adapted to sealingly engage the outer surface portion above the annulus port;

whereby workover may be performed through the offset bore and offset port.

35. A well production assembly located at an upper end of a string of tubing extending into a well, comprising:

a production tree having a longitudinal axis, an axial bore and a lateral production passage, the lateral production passage having an inlet at the bore and extending laterally through a sidewall of the production tree;

a tubing hanger landed in the axial bore and adapted to be located at an upper end of a string of tubing, the tubing hanger having a vertical production passage extending axially through the tubing hanger and a lateral production passageway which extends laterally from the vertical production passage through the tubing hanger and has an outlet at the exterior of the tubing hanger which registers with the inlet of the lateral production passage of the production tree;

the tubing hanger having an offset vertical passage extending through the tubing hanger from a lower end to an upper end of the tubing hanger offset from the vertical production passage, the offset vertical passage having a lower end adapted to be in communication with a tubing annulus surrounding the string of tubing;

a first closure member installed in the vertical production passage above the lateral production passageway of the tubing hanger; and a second closure member installed in the offset vertical passage.

36. The well production assembly according to claim 35, further comprising:

a removable internal tree cap which sealingly engages the bore of the tree above the tubing hanger, the tree cap having first and second vertical passages which are offset from and parallel to each other, the first vertical passage of the tree cap aligning with the co-axial production passage of the tubing hanger, the second vertical passage of the tree cap aligning with the offset vertical passage of the tubing hanger;

a third closure member installed in the first vertical passage of the tree cap; and a fourth closure member installed in the second vertical passage of the tree cap.

37. The well production assembly according to claim 35, further comprising:

a lateral flow passage extending laterally from the offset vertical passage through the tubing hanger and having an opening at the exterior of the tubing hanger; and a tree flow passage having an opening in the axial bore of the tree and extending laterally through the tree for sealingly registering with the opening of the lateral flow passage of the tubing hanger.

38. A well production assembly located at an upper end of a string of tubing extending into a well, comprising:

a production tree having a longitudinal axis, an axial bore and first and second lateral passages, the first and second lateral passages having an inlet at the bore and extending laterally through a sidewall of the production tree;

a tubing hanger landed in the axial bore and adapted to be located at an upper end of a string of tubing, the tubing hanger having a vertical production passage extending axially through the tubing hanger and a first lateral passageway which extends laterally from the vertical production passage through the tubing hanger and has an outlet at the exterior of the tubing hanger which registers with the inlet of the first lateral passage of the production tree;

the tubing hanger having an offset passage extending through the tubing hanger from a lower end to an upper end of the tubing hanger offset from the vertical production passage and a second lateral passageway which extends laterally from the offset vertical passage through the tubing hanger and has an outlet at the exterior of the tubing hanger which registers with the inlet of the second lateral passage of the tree;

a first removable closure member installed in the vertical production passage above the first lateral passage of the tubing hanger;

a second removable closure member installed in the offset passage above the second lateral passageway of the tubing hanger; and the vertical production passage and the offset passage being selectively used for workover upon removal of the first and second removable closure members.

* * * * *